US009948021B2

(12) United States Patent
Zhang et al.

(10) Patent No.: US 9,948,021 B2
(45) Date of Patent: Apr. 17, 2018

(54) POWER RECEPTACLES AND ASSOCIATED METHODS OF ASSEMBLY

(71) Applicant: Eaton Intelligent Power Limited, Dublin (IE)

(72) Inventors: George Zhang, Shanghai (CN); Alex Zhuang, Shangai (CN); Dai Vo, McDonough, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/235,356

(22) Filed: Aug. 12, 2016

(65) Prior Publication Data

US 2018/0048087 A1 Feb. 15, 2018

(51) Int. Cl.
*H01R 4/50* (2006.01)
*H01R 13/508* (2006.01)
*H01R 43/18* (2006.01)

(52) U.S. Cl.
CPC ..... *H01R 13/508* (2013.01); *H01R 43/18* (2013.01)

(58) Field of Classification Search
CPC ..... H01R 13/6275; H01R 25/003; H01R 13/7175; H01R 33/09
USPC ..... 439/345, 214, 490, 375
See application file for complete search history.

(56) References Cited

U.S. PATENT DOCUMENTS 8,222,521 B2 * 7/2012 Kimbrell ..... H01R 13/512 174/66
8,435,055 B1 * 5/2013 Bhosale ..... H01R 13/4534 439/145

OTHER PUBLICATIONS

Arrow-Hart, Inc., Manufacturing Drawing, 1977, 1 page.
Eaton, Arrow-Hart, Inc, Industrial grad straight blade & locking devices, product and specifications brochure, Feb. 2014, 28 pages.

* cited by examiner

*Primary Examiner* — Phuong Chi T Nguyen
(74) *Attorney, Agent, or Firm* — Myers Bigel, P.A.

(57) ABSTRACT

Power receptacles with cover with an electrical outlet and a base attached to the cover. The base includes a plurality of spaced apart electrical contacts under the electrical outlet. At least one of the cover or the base includes at least one internal attachment member that cooperates with a receiving channel in the other of the cover or the base to frictionally attach the cover and base together. The at least one attachment member can be a plurality of such members and one or more can include ribs, optionally crush ribs.

21 Claims, 6 Drawing Sheets

POWER RECEPTACLES AND ASSOCIATED METHODS OF ASSEMBLY

FIELD OF THE INVENTION

The present invention relates to power receptacles.

BACKGROUND OF THE INVENTION

Power receptacles conventionally employ rivets that attach a cover to a base. There is a need for improved cover to base interfaces.

SUMMARY OF EMBODIMENTS OF THE INVENTION

Embodiments of the present invention are directed to power receptacles with internal attachment members that can slidably attach the cover and the base.

Embodiments of the present invention are directed to power receptacles that include a cover with an electrical outlet and a base attached to the cover. The base includes a plurality of spaced apart electrical contacts under the electrical outlet. At least one of the cover or the base (or both) includes at least one internal attachment member that cooperates with a receiving channel in the other of the cover or the base to frictionally attach the cover and base together.

The at least one internal attachment member can be a plurality of internal attachment members.

The internal attachment member(s) can be cylindrical and at least one of the internal attachment members can have an open center channel One of the internal attachment members can have a larger outer diameter than at least one other.

The at least one internal attachment member can have a length that is between 0.1 inches and about 0.4 inches and can have a cylindrical wall with a longitudinally extending slot.

The at least one internal attachment member can include a plurality of longitudinally extending spaced apart external ribs that contact an inner surface of a wall of the receiving channel to frictionally attach the cover and base together. The ribs can optionally be crush ribs.

The at least one internal attachment member can have a cylindrical wall with circumferentially spaced apart ribs on an outer surface thereof. The at least one internal attachment member can have a longitudinally extending slot extending between adjacent external ribs in the wall.

The power receptacle can further include first and second rivets positioned on opposing sides of the electrical outlet. The first and second rivets can extend through aligned channels in the cover and base. The first and second rivets can have a length that is at least twice a length of the at least one internal attachment member.

The at least one internal attachment member can include a first internal attachment member that has an open center channel and surrounds a fixation device extending through the open center channel. The receiving channel can have a first portion with a larger diameter and shorter length than a second portion so that the receiving channel frictionally engages the first internal attachment member with the open center channel at the first portion and the fixation device extends through the first portion and the second portion so that a tail thereof is exposed on a bottom of the base.

The cover can include the at least one internal attachment member that cooperates with the receiving channel in the base to frictionally attach the cover and base together.

The at least one internal attachment member can include or be only three internal attachment members, including first and second cylindrical internal attachment members with open center channels residing closer to a first short side of the cover and a third cylindrical internal attachment member with an open center channel residing closer to a second opposing short side of the cover.

The first and second internal attachment members can have smaller outer diameters than the third internal attachment member.

The power receptacle can be a three phase electrical outlet.

The internal attachment member(s) can be attached to the aligned receiving channel with a pull out force of between 1 lbf and 10 lbf, optionally between about 4 lbf and about 6 lbf.

The at least one internal attachment member can be a plurality of spaced apart internal attachment members. The cover can hold the internal attachment members and the base can hold aligned receiving channels. The power receptacle can further include first and second rivets that extend through the cover and the base to secure the cover and base together with a rivet attachment. The internal attachment members can frictionally pre-attach the cover and base together without the rivet attachment from the first and second rivets.

The internal attachment members can include first and second internal attachment members residing closer to a first short side of the cover and a third internal attachment member residing closer to a second opposing short side of the cover. One of the first and second rivets can extending through an open center channel of the third attachment member.

The power receptacle can further include first and second terminal screws that are orthogonal to the at least one internal attachment member. One of the at least one internal attachment member can reside between a short end of the cover and the first or second terminal screw.

Other embodiments are directed to methods of assembling a power receptacle. The methods include: providing a cover of a power receptacle; providing a base of a power receptacle; orienting the base and cover to face each other and aligning internal attachment members with mating channels; press-fitting the internal attachment members into the aligned mating channels; and then riveting the base and cover together after the press-fitting.

The internal attachment members can include external crush ribs. The press-fitting can be carried out by crushing the ribs against an inner surface of respective mating channels.

The method can further include inserting a rivet through one of the internal attachment members before, during or with the press-fitting and prior to the riveting.

The cover can hold the internal attachment members and the base can hold the mating channels. The internal attachment members can be cylindrical and at least one can have a larger outer diameter than another. The press-fitted internal attachment members can have a pull out force of between 1 lbf and 10 lbf, optionally between about 4 lbf and about 6 lbf.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
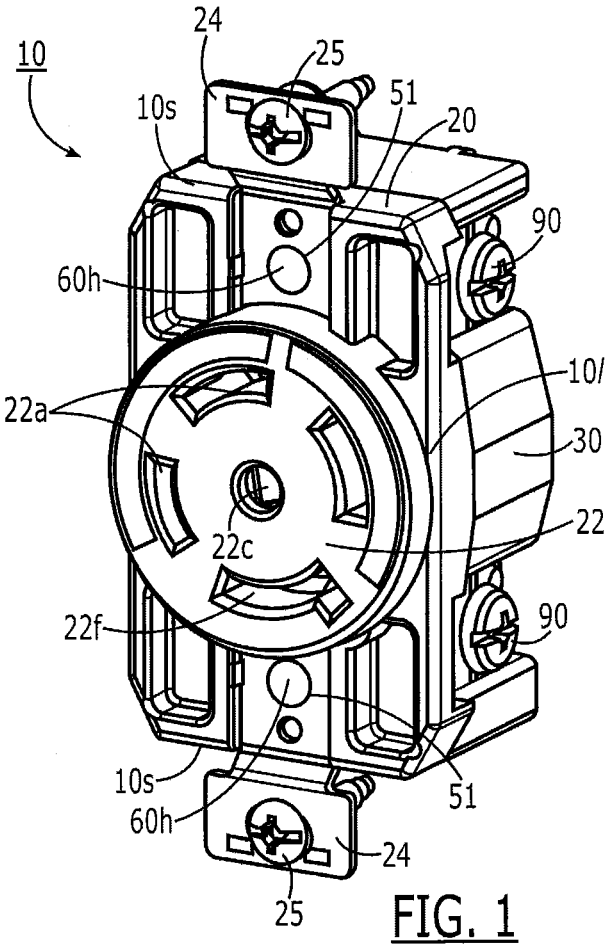
FIG. 1 is a front view of an exemplary power receptacle according to embodiments of the present invention.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10", 10'"). Abbreviated versions of the word "Figure" such as "FIG." and "Fig." are used interchangeably in the application. Broken line boxes in the figures indicate optional features.

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Turning now to the figures, FIGS. 1-6 illustrate an exemplary power receptacle 10, also interchangeably referred to as a "receptacle." As is well known, a power receptacle is a point of connection between electrically powered devices, such as computers, and a power distribution system, such as a power distribution of a structure such as a building. The power receptacle 10 can be configured, for example, as an in-floor, in-wall device, surface-mount device, or a device integrated into another device or even as an appliance.

Figure 2:
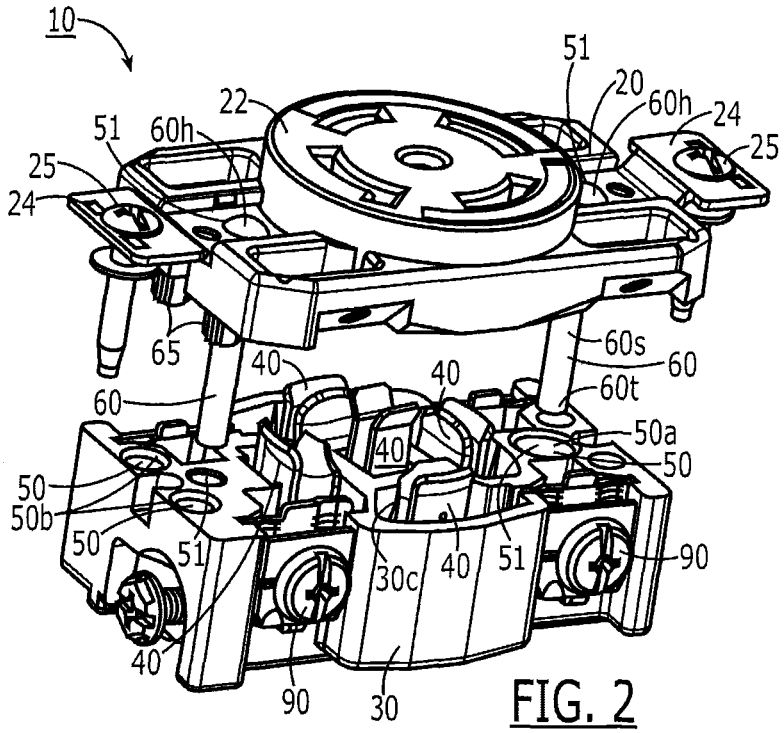
FIG. 2 is side, top perspective partially exploded view of the exemplary power receptacle shown in FIG. 1.

The receptacle 10 can have a cover 20 and a base 30 that are attached together. Referring to FIG. 2, the base 30 can have an internal cavity 30*c* that holds a plurality of spaced apart electrical contacts 40 that face the cover 20.

Figure 6:
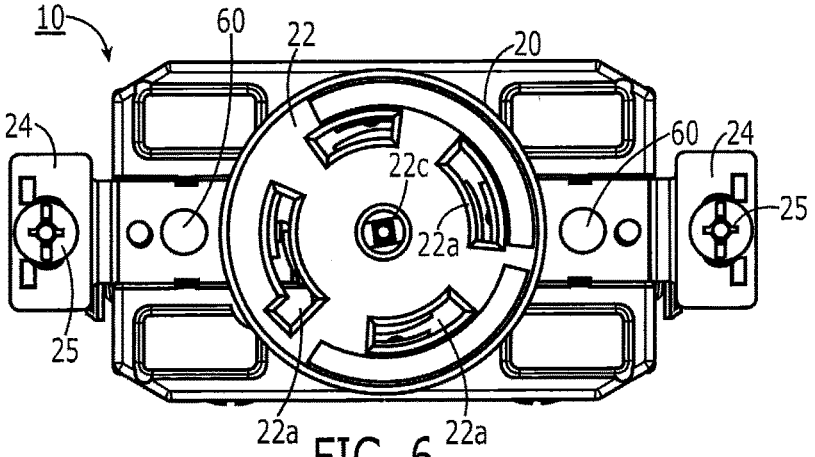
FIG. 6 is a top assembled view of the device shown in FIG. 1.

As shown in FIGS. 1, 2 and 6, the cover 20 of the power receptacle 10 can comprise at least one electrical outlet 22. The electrical outlet 22 can have at least one female connector or socket 22*f* which is configured to receive male connectors (plug-in electrical connectors) to engage the internal electrical contacts 40. In some embodiments, the socket 22*f* can be a 4-prong socket. The socket 22*f* can include a plurality of circumferentially extending and circumferentially spaced apart apertures 22*a* surrounding a central aperture 22*c*.

As shown in FIGS. 1-6, the receptacle 10 can include outer ears 24 that can included mounting (typically threaded) members 25 that can be used to attach to a desired structure for mounting the power receptacle 10. The ears 24 are typically attached to and/or part of the cover 20.

Figure 3:
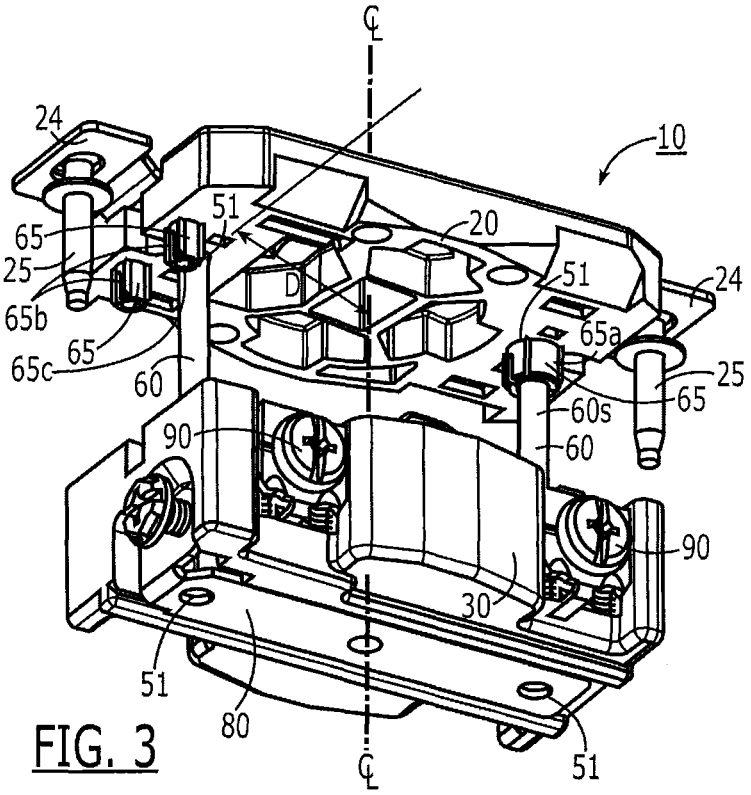
FIG. 3 is a side, bottom perspective partially exploded view of the exemplary power receptacle shown in FIG. 1.
Figure 4:
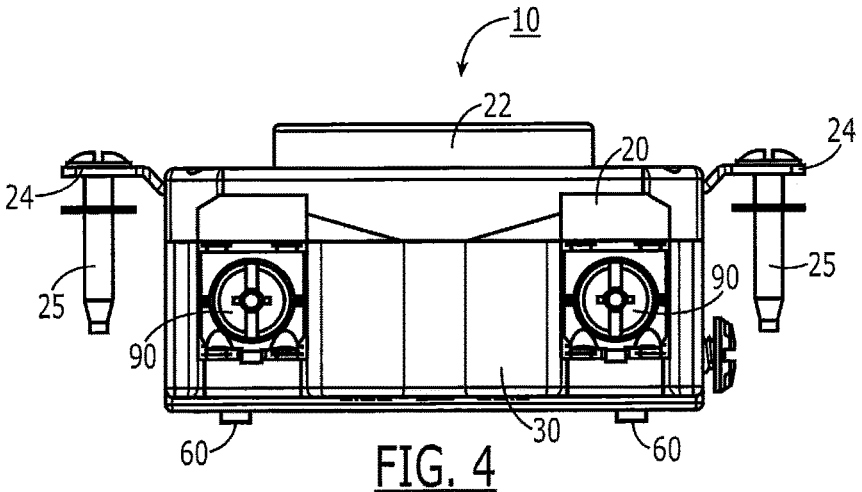
FIG. 4 is a side assembled view of the device shown in FIG. 1 according to embodiments of the present invention.
Figure 5:
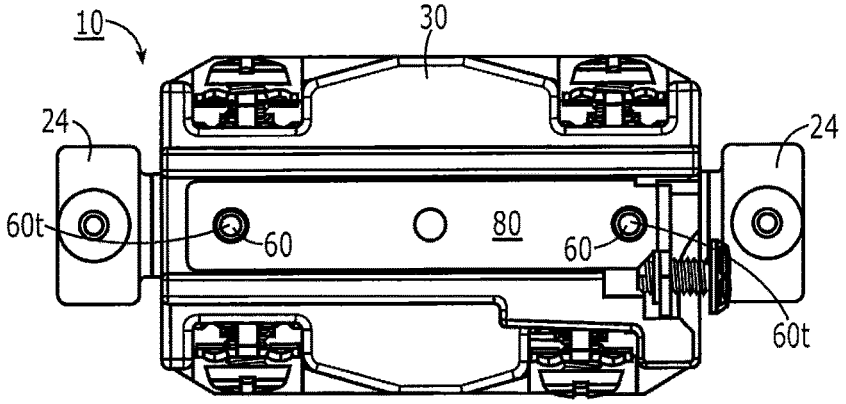
FIG. 5 is a bottom perspective view of the device shown in FIG. 1 according to embodiments of the present invention.

As shown in FIGS. 3 and 5, the receptacle 10 may include a ground strap 80 that can optionally reside on the bottom of the base 30.

Referring now to FIGS. 2 and 3, the receptacle 10 can include at least one internal attachment member 65 that extends inwardly and that can slidably enter and engage an aligned/mating receiving channel 50 to attach the cover 20 and the base 30. The internal attachment member(s) 65 can be configured to frictionally attach to the mating channel 50 with a pull out force that can allow manual disengagement of the base and cover. The internal attachment member(s) 65 can have pull out forces of between about 1 lbf to about 10 lbf, more typically between about 4 lbf and about 6 lbf. The at least one internal attachment member 65 can be used to pre-attach the cover 20 and the base 30 together before the fixation device 60 is secured to the base 30, the latter can provide a more secure attachment than the use of only the at least one internal attachment member 65. FIGS. 2 and 3 show the internal attachment member 65 as held by the cover 20 and projecting a short distance inward toward a channel 50 in the base 30. However, the reverse configuration may be used where the at least one internal attachment member 65 is held by the base 30 and projects toward the cover 20 and the cover 20 can include the mating channel 50. Also, the cover 20 and base 30 can each include one or more internal attachment members 65 and one or more receiving channels 50 (not shown).

The at least one internal attachment member 65 can comprise a plurality of external circumferentially spaced apart, longitudinally extending external ribs 65*r* that slidably engage a wall of a corresponding receiving channel 50. The ribs 65*r* may be crush ribs. Other configurations of the at least one internal attachment member 65 may be used. For example, the attachment member can taper outward along its axis and/or flex to be able to frictionally engage the wall of the receiving channel 50. Ribs 65*r* are not required and slots 65*s* are not required.

The internal attachment member(s) 65, with optional ribs 65*r*, can be polymeric molded members that may be unitary and monolithic to the base and/or cover 20, 30 or may be a mechanically attached component.

The term "crush ribs" refers to structural features that deform when contacted by an appropriately sized cooperating member when properly engaged/attached. The deformation can be permanent or may be sufficiently elastic to return the ribs to a pre-installation shape once attachment forces are removed. The ribs 65*r* (or internal ribs 50*r* of one or more receiving channels, where used such as shown in FIG. 8) can have a rounded outer surface that project outward from a supporting substrate or surface or may have a peak configuration or combinations of same or any other suitable shape. In some embodiments, the at least one fixation member 65 can include a plurality of circumferentially spaced apart ribs, shown as four ribs in FIGS. 7A and 7B, for example.

Figure 7A:
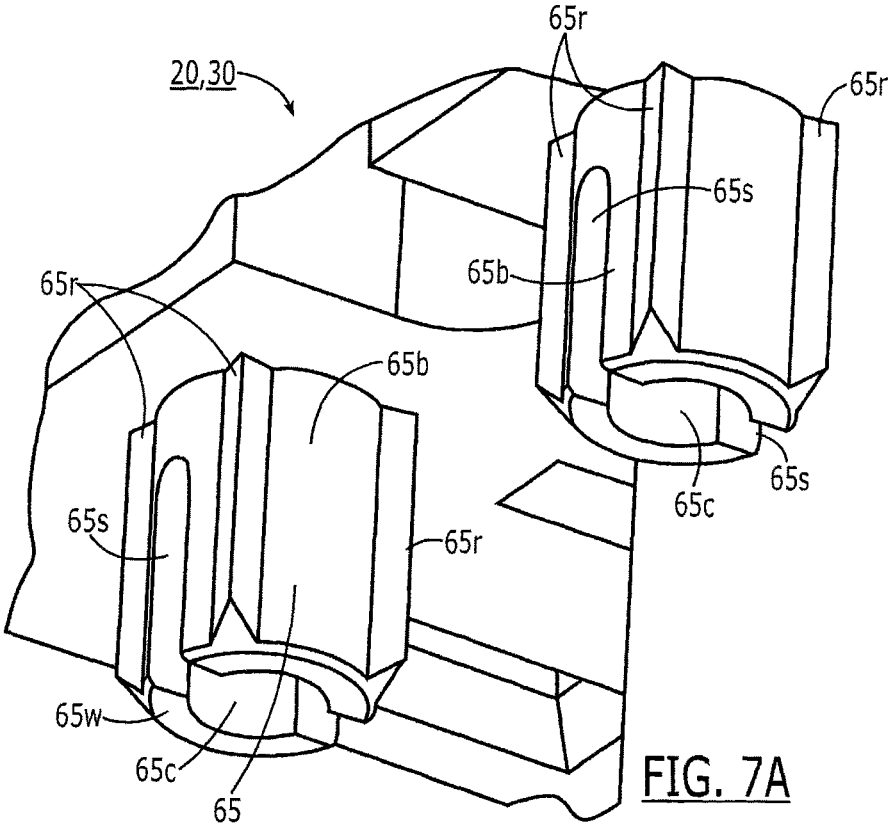
FIGS. 7A and 7B are greatly enlarged bottom perspective views of a power receptacle with exemplary inwardly extending members with external crush ribs according to embodiments of the present invention.
Figure 7B:
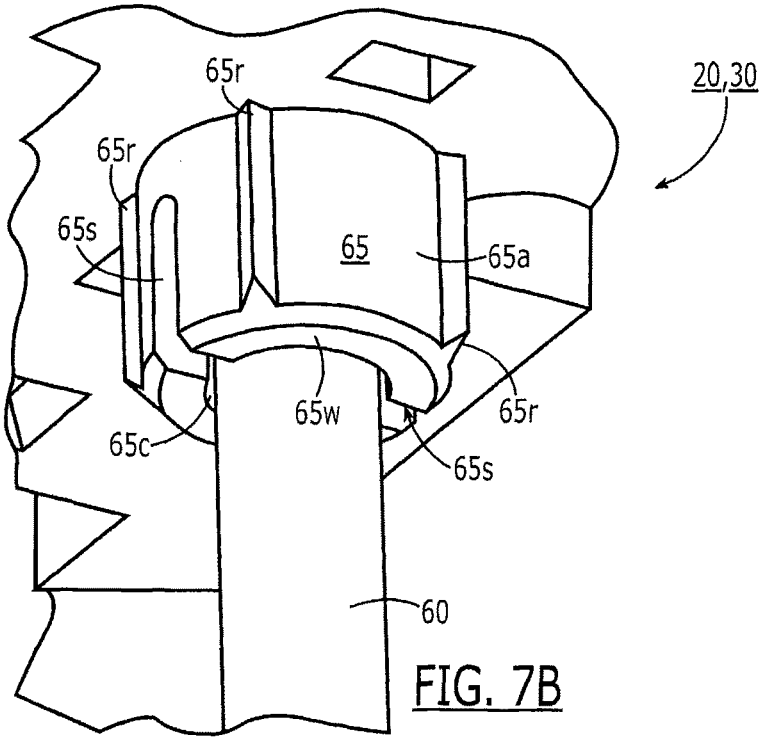
Figure 8:
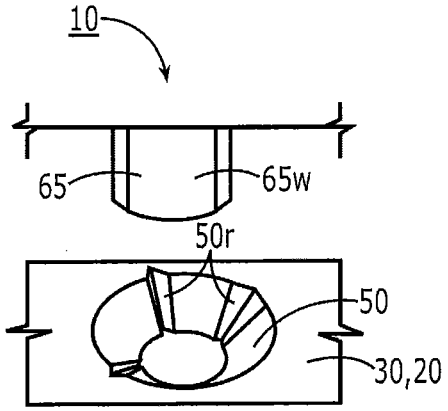
FIG. 8 is a schematic illustration of an internal attachment member and a receiving channel with crush ribs according to embodiments of the present invention.

As shown in FIGS. 3, 7A and 7B, for example, one or more of the at least one internal attachment member 65 can be cylindrical and may have an open center channel 65*c*. Where a plurality of internal attachment members 65 are used, each of can have the same internally extending length or different ones of the internal attachment members 65 can have different lengths. Each internal attachment member 65 can be the same size and shape or be a different size and/or shape.

The internal attachment member(s) 65 can have a short length that is between about 0.1 inches and about 0.5 inches, more typically about 0.2 inches and is typically less than half the length of the mounting member 25 and/or fixation device 60. That is the fixation device 60 can be at least twice the length of the attachment member 65, typically at least about 0.4 inches such as between about 0.4 inches and about 2 inches.

As shown in FIG. 3, in some embodiments, at least one of the at least one alignment member 65 can be concentric with and reside about a shaft 60*s* (outer surface) of a longer fixation (mechanical fastener) device 60.

The longer fixation device 60 can be a rivet, typically a rivet screw, but other mechanical fasteners may be used.

The receptacle 10 can also include terminal screws 90 that are orthogonal to the fixation devices 60 and extend through the base 30.

As shown in FIG. 2, the longer fixation device 60 can, before being installed and/or before engaged with the base 30, have a smooth cylindrical shaft 60*s* with a head on one end 60*h* and a tail 60*t* on the other. The tail 60*t* (opposite the head) can extend through the bottom of the base 30. To install, the fixation devices 60 can be placed in aligned channels 51 extending through the cover 20 and base 30. As shown in FIG. 5, after insertion through the channel 51 in the base 30, the tail 60*t* can be deformed to expand to a larger size, typically about 1.1 to about 2 times, more typically about 1.5 times, the original shaft diameter.

Figure 9:
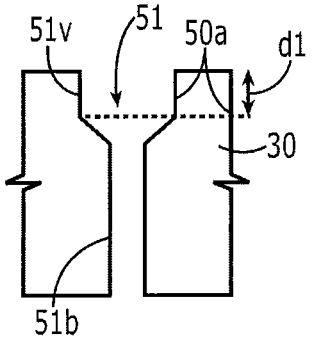
FIG. 9 is a schematic cross-sectional view of a receiving channel according to embodiments of the present invention.

FIG. 9 illustrates that the base 30 can have a channel 51 for one fixation device 60 that can have a first portion 51*u* with a larger diameter than a longer second portion 51*b*. The first portion 51*f* defines the receiving channel 50*a* for the internal member 65 that is concentric with the fixation device 60. The first portion 51*u* can have an upper portion with a depth "d" and a first diameter that is sized to snugly receive and abut the aligned internal member 65. The second portion 51*b* can be longer than the first portion and have a smaller diameter that corresponds to the outer diameter of the shaft 60*s* of the fixation device 60.

Typically, the at least one internal attachment member 65 is a plurality, shown as three but two or more than three may be used. The internal attachment members 65 can have a larger outer diameter than the diameter of the fixation device 60.

In some embodiments, there are a plurality of internal attachment members 65, at least one on one side of the socket 22 and another at least one on an opposing side of the socket 22, each residing between a respective ear 24 and fixation device 60, i.e., rivet.

Referring to FIG. 1, the receptacle 10 can be rectangular and have two opposing long sides 10*l* connected by two opposing short sides 10*s*. FIGS. 2, 3, 7A and 7B show that a pair of laterally spaced apart and longitudinally aligned internal attachment members 65*b* can reside adjacent one short side 10*s* and a single inwardly extending attachment member 65*a* can reside adjacent the other short side 10*s*.

As shown in FIG. 3, the pair of internal (inwardly extending) attachment members 65*b* can be laterally spaced apart and aligned to reside at a common longitudinal distance "D" from the center of the receptacle 10 (indicated by the dashed centerline axis), closer to the ear 24 than the socket 22, and can have a smaller inner and outer diameter than that of the single member 65*a*. A fixation device 60 can reside between the pair of internal inwardly extending members 65*b*, closer to the socket. One fixation device 60 can extend through an open center channel 65*c* of the single internal inwardly extending member 65*a*.

FIG. 8 illustrates an embodiment where the channel 50 can comprise internal crush ribs 50*r* that engage an outer wall of the inwardly extending attachment member 65. The attachment member 65 may have a continuous solid outer wall or may be discontinuous and the longitudinally extending slots 65*s* are optional. As indicated by the reference to 20, 30 and 30, 20 in FIG. 8, it is also contemplated that the channel 50 may be in the cover 20 rather than the base 30 and the at least one inwardly extending attachment member 65 can be held by the base 30.

As shown, for example, in FIGS. 7A and 7B, the inwardly extending member(s) 65 can be cylindrical with an open center channel 65*c* surrounded by a wall 65*w* with at least one longitudinally extending slot 65*s*. In some embodiments, as shown in FIGS. 7A and 7B, the at least one slot 65*s* can comprise diametrically opposed and longitudinally extending slots 65*s* positioned across the open center channel 65*c*. A slot 65*s* can reside between pairs of adjacent ribs 65*r*.

The receptacle 10 can be configured as a single receptacle. In some embodiments, the receptacle 10 can be configured as a single gang, dual gang or other multiple gang receptacle. The receptacle 10 can be a three phase receptacle of suitable amperage and voltage rating for residential or commercial use. In some particular embodiments, the receptacle 10 can be a 30 A 240/415V 4P5W device.

The receptacle 10 can be configured as an Arc Fault Circuit Interrupter (AFCI) and/or Ground Fault Circuit Interrupter (GFCI) receptacle. As is well known, AFCI and GFCI receptacles are among a variety of overcurrent protection devices used for circuit protection and isolation. A GFCI is a device that shuts off an electric circuit when it detects that current is flowing along an unintended path to reduce the risk of electric shock. The GFCI can be manually reset by pushing a reset button. There can also be a test button that can be used to verify that the GFCI works. An AFCI can be designed to help prevent fires by detecting an unintended electrical arc and disconnecting the power before the arc starts a fire.

Figure 10:
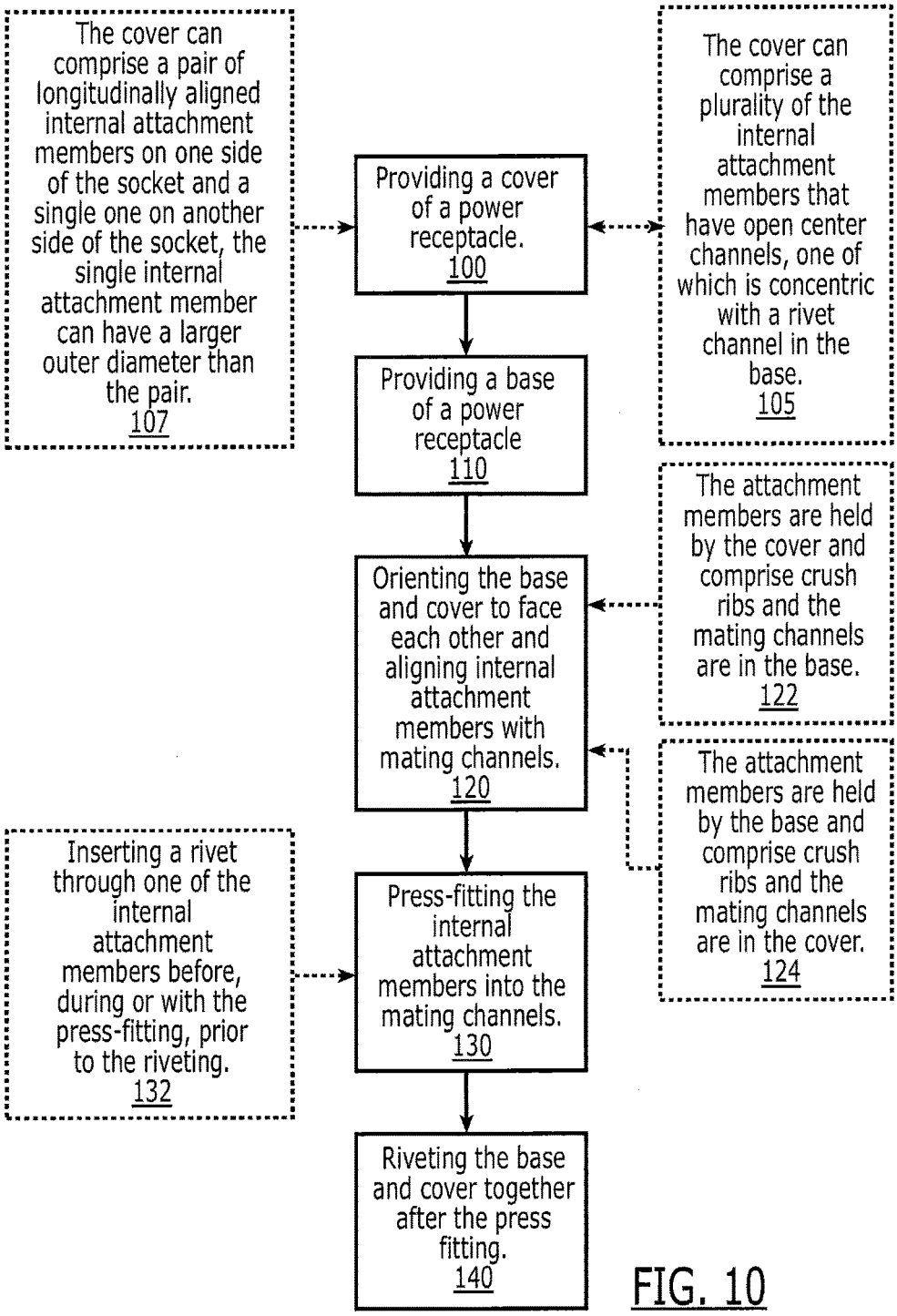
FIG. 10 is a flow chart of exemplary assembly operations of a power receptacle according to embodiments of the present invention.

FIG. 10 illustrates exemplary operations that can be used to assemble a power receptacle according to embodiments of the present invention. A cover of a power receptacle is provided (block 100). A base of a power receptacle is also provided (block 110). The base and cover are oriented to face each other and align internal attachment members with mating channels (block 120). The internal attachment members are press-fitted into the mating channels (block 130). The base and cover can be riveted together after the press fitting (block 140).

The cover can comprise a plurality of the internal attachment members that have open center channels, one of which is concentric with a rivet channel in the base (block 105).

The attachment members can be held by the cover and comprise crush ribs and the mating channels are in the base (block 122).

The attachment members are held by the base and comprise crush ribs and the mating channels are in the cover (block 124).

The cover can comprise a pair of longitudinally aligned internal attachment members on one side of the socket and a single one on another side of the socket, the single internal attachment member can have a larger outer diameter than the pair (block 107).

Inserting a rivet through one of the internal attachment members before, during or with the press-fitting, prior to the riveting (block 132).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A power receptacle, comprising:

a cover with an electrical outlet;

a base attached to the cover, the base comprising a plurality of spaced apart electrical contacts under the electrical outlet, wherein at least one of the cover or the base includes at least one internal attachment member that cooperates with an aligned receiving channel in the other of the cover or the base to frictionally attach the cover and base together; and first and second rivets positioned on opposing sides of the electrical outlet, wherein the first and second rivets extend through aligned channels in the cover and base, and wherein the first and second rivets have a length that is at least twice a length of the at least one internal attachment member.

2. The power receptacle of claim 1, wherein the at least one internal attachment member has a length between 0.1 inches and about 0.4 inches and comprises a cylindrical wall with a longitudinally extending slot.

3. The power receptacle of claim 1, wherein the cover includes the at least one internal attachment member that cooperates with the receiving channel in the base to frictionally attach the cover and base together.

4. The power receptacle of claim 1, further comprising first and second terminal screws that are orthogonal to the at least one internal attachment member, and wherein one of the at least one internal attachment member resides between a short end of the cover and the first or second terminal screw.

5. The power receptacle of claim 1, wherein the at least one internal attachment member comprises a first internal attachment member and a second spaced apart internal attachment member, wherein the first and second internal attachment members are cylindrical, and wherein at least one of the first and second internal attachment members has an open center channel.

6. The power receptacle of claim 5, wherein one of the internal attachment members has a larger outer diameter than at least one other.

7. The power receptacle of claim 1, wherein the at least one internal attachment member comprises a plurality of longitudinally extending spaced apart external ribs that contact an inner surface of a wall of the receiving channel to frictionally attach the cover and base together.

8. The power receptacle of claim 7, wherein the ribs are crush ribs.

9. The power receptacle of claim 1, wherein the at least one internal attachment member comprises first, second and third cylindrical internal attachment members, wherein the first and second cylindrical internal attachment members have open center channels and reside closer to a first short side of the cover than the third cylindrical internal attachment member, and wherein the third cylindrical internal attachment member has an open center channel and resides closer to a second opposing short side of the cover than the first short side of the cover.

10. The power receptacle of claim 9, wherein the first and second cylindrical internal attachment members have smaller outer diameters than the third cylindrical internal attachment member.

11. The power receptacle of claim 1, wherein the at least one internal attachment member is a plurality of spaced apart internal attachment members, wherein the cover holds the internal attachment members and the base holds the aligned receiving channels, wherein the power receptacle further comprises first and second rivets that extend through the cover and the base to secure the cover and base together via a rivet attachment, and wherein the internal attachment members frictionally pre-attach the cover and base together without the rivet attachment from the first and second rivets.

12. The power receptacle of claim 11, wherein the plurality of internal attachment members include first and second internal attachment members residing closer to a first short side of the cover and a third internal attachment member residing closer to a second opposing short side of the cover, with one of the first and second rivets extending through an open longitudinally extending center channel of the third attachment member.

13. A power receptacle, comprising:

a cover with an electrical outlet; and a base attached to the cover, the base comprising a plurality of spaced apart electrical contacts under the electrical outlet, wherein at least one of the cover or the base includes at least one internal attachment member that cooperates with an aligned receiving channel in the other of the cover or the base to frictionally attach the cover and base together, wherein the at least one internal attachment member has a cylindrical wall with circumferentially spaced apart longitudinally extending external ribs thereon, and wherein the at least one internal attachment member comprises a longitudinally extending slot extending between adjacent ribs.

14. A power receptacle, comprising:

a cover with an electrical outlet; and a base attached to the cover, the base comprising a plurality of spaced apart electrical contacts under the electrical outlet, wherein at least one of the cover or the base includes at least one internal attachment member that cooperates with an aligned receiving channel in the other of the cover or the base to frictionally attach the cover and base together;

wherein the at least one internal attachment member comprises a first internal attachment member that has an open center channel and surrounds a fixation device extending through the open center channel, and wherein the receiving channel has a first portion with a larger diameter and shorter length than a second portion so that the receiving channel frictionally engages the first internal attachment member with the open center channel at the first portion and the fixation device extends through the first portion and the second portion so that a tail thereof is exposed on a bottom of the base.

15. A power receptacle, comprising:

a cover with an electrical outlet; and a base attached to the cover, the base comprising a plurality of spaced apart electrical contacts under the electrical outlet, wherein at least one of the cover or the base includes at least one internal attachment member that cooperates with an aligned receiving channel in the other of the cover or the base to frictionally attach the cover and base together, wherein the power receptacle is a three phase electrical outlet, and wherein the at least one internal attachment member is attached to the aligned receiving channel with a pull out force of between 1 lbf and 10 lbf.

16. The power receptacle of claim 15, wherein the pull out force is between about 4 lbf and about 6 lbf.

17. A method of assembling a power receptacle, comprising:

providing a cover of a power receptacle;

providing a base of a power receptacle;

orienting the base and cover to face each other and aligning internal attachment members with mating channels;

press-fitting the internal attachment members into the aligned mating channels; and then riveting the base and cover together after the press-fitting, wherein the press-fitted internal attachment members have a pull out force of between 1 lbf and 10 lbf.

18. The method of claim 17, wherein the internal attachment members comprise external crush ribs, and wherein the press-fitting is carried out by crushing the ribs against an inner surface of respective mating channels.

19. The method of claim 17, further comprising inserting a rivet through one of the internal attachment members before, during or with the press-fitting and prior to the riveting.

20. The method of claim 17, wherein the cover holds the internal attachment members and the base holds the mating channels, wherein the internal attachment members are cylindrical and at least one has a larger outer diameter than another.

21. The method of claim 17, wherein the press-fitted attachment members have a pull out force of between about 4 lbf and about 6 lbf.

* * * * *